US012746588B2

(12) United States Patent
Oliveira et al.

(10) Patent No.: US 12,746,588 B2
(45) Date of Patent: Sep. 29, 2026

(54) MOBILE FACTORY OF STEEL SHEET COIL HELICAL PIPE

(71) Applicant: MEMPS-TUBOS HELICOIDAIS INDÚSTRIA E SERVIÇOS LTDA, São Luís (BR)

(72) Inventors: Ene Pires De Oliveira, São Luís (BR); Ricardo Miguel Leitão Pereira, São José de Ribamar (BR)

(73) Assignee: MEMPS-TUBOS HELICOIDAIS INDÚSTRIA E SERVIÇOS LTDA, São Luís (BR)

( * ) Notice: Subject to any disclaimer, the term of this patent is extended or adjusted under 35 U.S.C. 154(b) by 270 days.

(21) Appl. No.: 18/556,400

(22) PCT Filed: Apr. 20, 2021

(86) PCT No.: PCT/BR2021/050163
§ 371 (c)(1),
(2) Date: Oct. 20, 2023

(87) PCT Pub. No.: WO2022/221929
PCT Pub. Date: Oct. 27, 2022

(65) Prior Publication Data

US 2024/0181514 A1 Jun. 6, 2024

(51) Int. Cl.
*B21C 37/12* (2006.01)

(52) U.S. Cl.
CPC ..... *B21C 37/122* (2013.01); *B21C 37/127* (2013.01)

(58) Field of Classification Search
CPC ..... B21C 37/12; B21C 37/122; B21C 37/127
See application file for complete search history.

(56) References Cited

U.S. PATENT DOCUMENTS 3,762,624 A * 10/1973 Sprung ..... B21C 37/08 228/103
3,997,098 A * 12/1976 Van Petten ..... B21C 37/12 210/457
4,081,981 A 4/1978 Lipp
4,476,703 A * 10/1984 Williamson ..... B21C 37/083 72/181
6,000,261 A * 12/1999 Johnston ..... B21C 37/122 72/49

(Continued)

FOREIGN PATENT DOCUMENTS

BR PI0802712 A2 3/2010
EP 1812192 B1 3/2008

(Continued)

OTHER PUBLICATIONS

International Search Report issued on Dec. 18, 2021, in corresponding International Application No. PCT/BR2021/050163, 6 pages.

*Primary Examiner* — Teresa M Ekiert
(74) *Attorney, Agent, or Firm* — Maier & Maier, PLLC

(57) ABSTRACT

A mobile factory of steel sheet coil helical pipe includes a factory for the production of helical pipes that can be mounted on trailers, rafts, or container-type structures that is distinguished by its high production speed and use of steel sheet coils of up to 1" possible thanks to the use of an optional coil driver, a beveler and a wire welding system that may contain two, three, four, or five welding wires per pass (internal and external).

9 Claims, 8 Drawing Sheets

(56) References Cited

U.S. PATENT DOCUMENTS

| | | | | |
|---|---|---|---|---|
| 2002/0088785 | A1* | 7/2002 | Coughlin | B21C 37/127 219/60 R |
| 2006/0156775 | A1* | 7/2006 | Nyssen | B21C 37/126 72/49 |
| 2012/0151978 | A1* | 6/2012 | Zepp | B21C 37/12 72/6.1 |

FOREIGN PATENT DOCUMENTS

| | | | |
|---|---|---|---|
| ES | 390215 | A1 | 3/1974 |
| WO | 2009075525 | A2 | 6/2009 |

* cited by examiner

MOBILE FACTORY OF STEEL SHEET COIL HELICAL PIPE

FIELD

This patent refers to a mobile factory that can be mounted on a truck, raft or container-type structure, which comprises all the equipment and tools necessary for the manufacture of helical pipes, whose distinguishing feature is its increase in production speed, resulting principally from gains in the movement of the coil, the preparation of the edges of the sheet used and in the welding to obtain the pipe.

The invention in question is used in the field of heavy mechanics, more specifically in means for manufacturing steel sheet coil pipes with helical stitching in loco.

BACKGROUND

The production of pipes with helical seams dates back to the middle of the early $20^{th}$ century, and is one of the forms most commonly used today by the pipe manufacturing industry, in adductors, metal liners, oil and gas transportation, among others. The use of helical stitching in production brings advantages such as a reduction in costs by using the equipment to manufacture pipes with different diameters, savings in the reduction of the factory layout and mechanical performance equal to or better than other types of stitching.

Normally, pipe production takes place at fixed industrial plants. Thus, the process is limited by the length of the pipes, either due to the process of storage or handling. When they measure over 30 meters, they become unviable in terms of movement and transportation logistics, since they require special authorizations, according to RESOLUTION No. 1, OF Jan. 6, 2020, DNIT.

In this context, new technologies that allow for improvements in logistical activity regarding the supply of pipes to a site and increased productivity are welcome in the field in question.

The current state of the art includes patent document PI 0802712-9 entitled "MOBILE SHEET HELICAL PIPE FACTORY"—which refers to a factory, composed of: an unwinder; a puller assembly; press; side guide rollers; calander; welding machine assembly; electrical supply source; and other means necessary for manufacturing steel sheet helical pipes: it is mobile and mounted on a low trailer of a mobile assembly of a tractor-truck, such that said mobile factory can be moved to the construction site where the pipe will be used and manufacture it "in loco", directly at the specified length, without the need for seams, and where the roller bed is a dismountable structure that can be transported, together with other equipment, tools and materials, by auxiliary trucks, which also form part of the factory; said roller bed being mounted orthogonally on the trailer at the exit of the calander.

The factory foreseen in the document above provides significant improvements in cost reduction, which include improved mechanical performance, as it significantly reduces the number of seams in the pipes; manufacture of pipes in remote locations and many places with poor accessibility; and pipes of greater than average lengths manufactured at fixed plants. However, the principal problem encountered in the above solution is the productivity of the process which is restricted to the thickness of the sheet to be welded; the lack of bevels on the sheets; the welding speed range that depends on factors such as sheet thickness; the welding energy used and the amount of welding wire, limited to one wire; and the time taken by the crane to move the coil.

SUMMARY

This invention seeks to provide a steel sheet coil helical pipe factory which, in addition to being mounted on a low trailer, can be mounted on a raft and container-type structure;

This invention seeks to provide a steel sheet coil helical pipe factory with higher manufacturing speed and thus, increased productive;

This invention seeks to provide a steel sheet coil helical pipe factory capable of producing pipes of any length, like stationary factories, in loco, that is, on site and of the same quality, thus reducing problems related to design and logistics;

This invention seeks to provide a steel sheet coil helical pipe factory capable of centering the joints of the sheet to improve the welding of the top, thanks to the beveler that creates a chamfer on the sides of said sheet, thereby increasing the speed of the welding. The absence of the bevel can cause problems of lack of fusion, or inefficient fusion, or fusion only on one side of the joint;

This invention seeks to provide a steel sheet coil helical pipe factory which, by beveling the sides of the sheet, also allows for complete penetration of the weld into the sheet joints at greater thicknesses and with a smaller number of passes, in addition to using a lower/or equal amount of energy;

This invention seeks to provide a steel sheet coil helical pipe factory capable of increasing production speed through the use of multiple welding wires to perform the stitching of the sheet in the form of a helical seam. The increase in production capacity is proportional to the amount of wire used, either in the internal or external welding, which can vary from two to five wires per weld;

This invention seeks to provide a steel sheet coil helical pipe factory equipped with an optional coil driver, applicable only to the thicker steel sheet coils that reduce the change time of this resource, without the need for external media, thus increasing the productivity of the factory;

This invention seeks to provide a steel sheet coil helical pipe factory with additional presses and pullers, one being additional, which serve to work thicker sheets without reducing speed, as well as guide tables;

This invention seeks to provide a steel sheet coil helical pipe factory with a great cost-benefit ratio.

The invention is a factory for producing helical pipes by welding on steel sheets, mounted on trailers, rafts and container-type structures, whose primary advantage is its production speed, independently of the thickness of the steel sheet, resulting from the action of a beveler, with a variable angle, which on milling the sides thereof favors the joint/welding of the top, the use of two to five welding wires in the internal and external seam, and provides speed in the movement of the coils thanks to a coil driver used on thicker steel sheets.

BRIEF DESCRIPTION OF THE FIGURES

The invention is described below in its form of embodiment, and, for improved comprehension reference is made to the attached drawings, which represent.

DETAILED DESCRIPTION OF THE EMBODIMENTS

Figure 1:
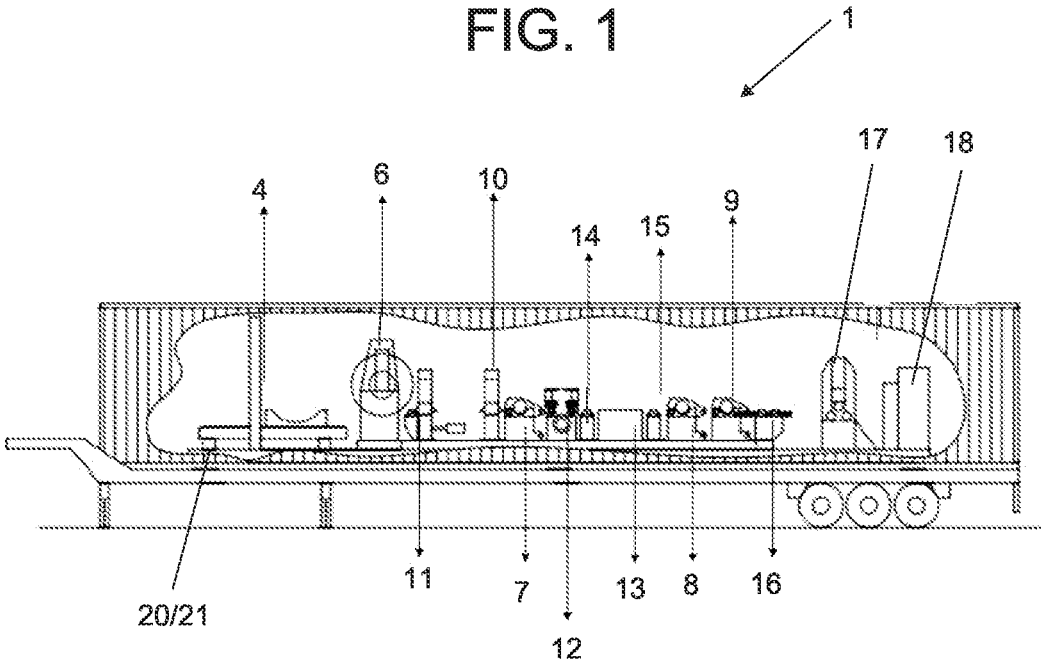
FIG. 1: Schematic side view of the mobile factory of helical pipe mounted on a trailer.
Figure 2:
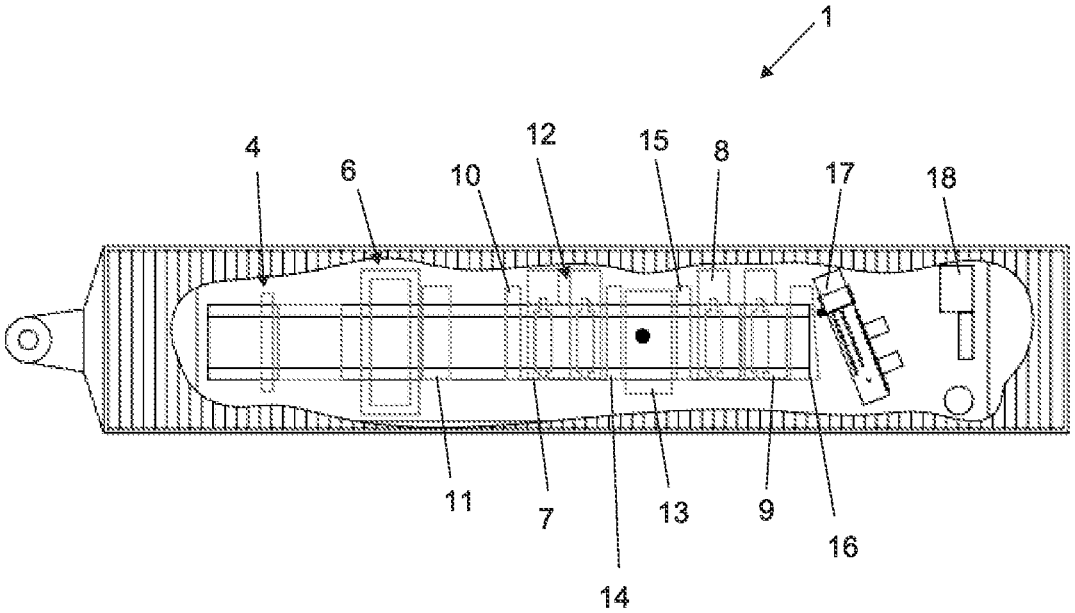
FIG. 2: Upper view of the beveler of the mobile factory of helical pipe mounted on a trailer.
Figure 3:
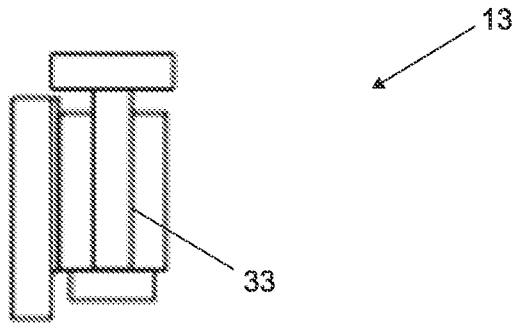
FIG. 3: Upper view of the beveler of the mobile factory of helical pipe.
Figure 4:
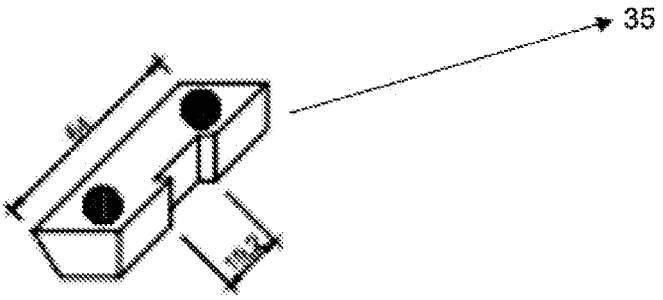
FIG. 4: Side view of the beveler of the mobile factory of helical pipe, with detail of the cutting element.
Figure 5:
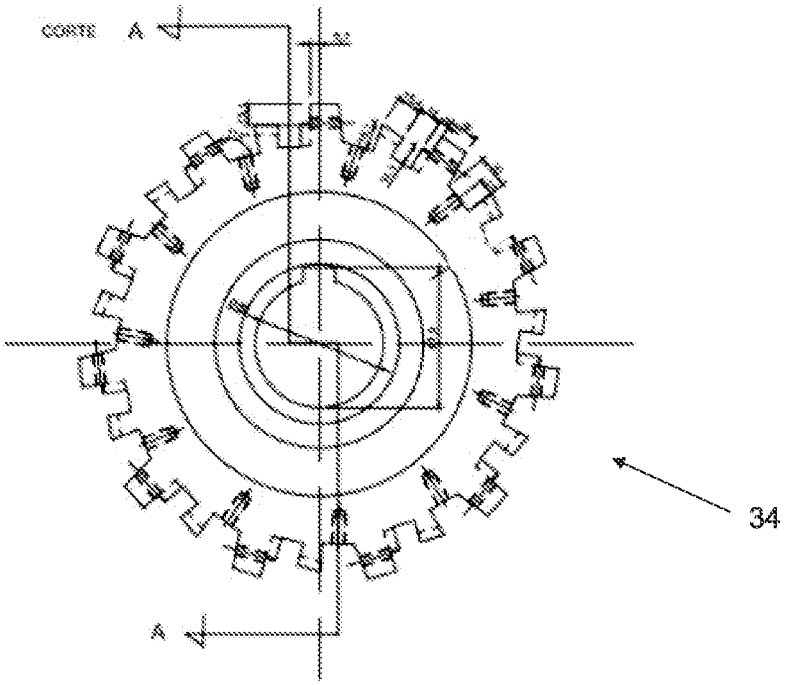
FIG. 5: Side view of the welding assembly of the mobile factory of helical pipe, with detail of the cutting element, with two welding wires.
Figure 6:
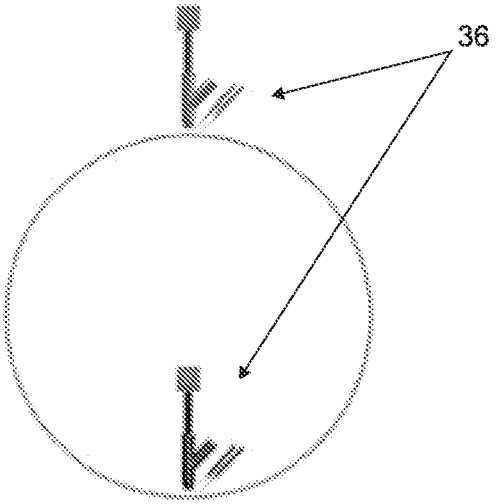
FIG. 6: Side view of the welding assembly of the mobile factory of helical pipe mounted on a trailer, with three welding wires.
Figure 7:
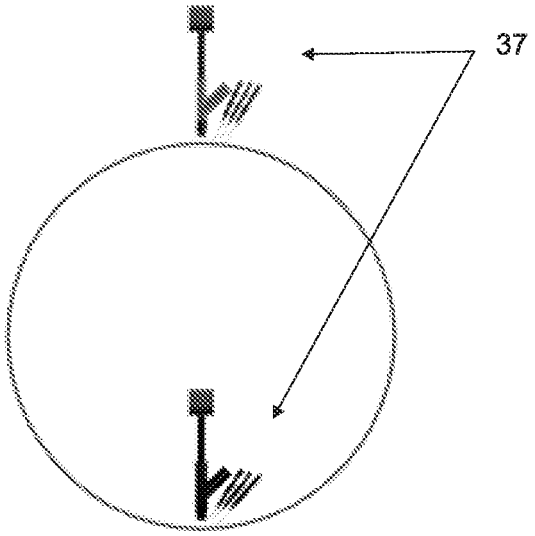
FIG. 7: Side view of the welding assembly of the mobile factory of helical pipe, with four welding wires.
Figure 8:
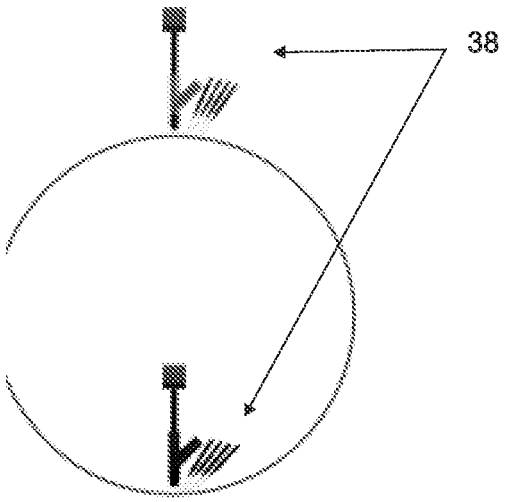
FIG. 8: Side view of the welding assembly of the mobile factory of helical pipe, with five welding wires.
Figure 9:
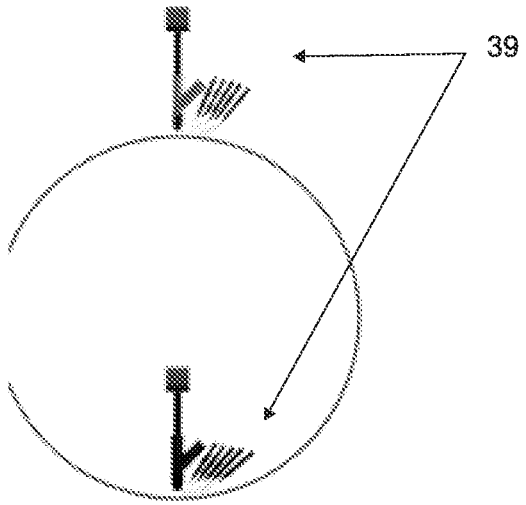
FIG. 9: Front view of the coil driver of the mobile factory of helical pipe.
Figure 10:
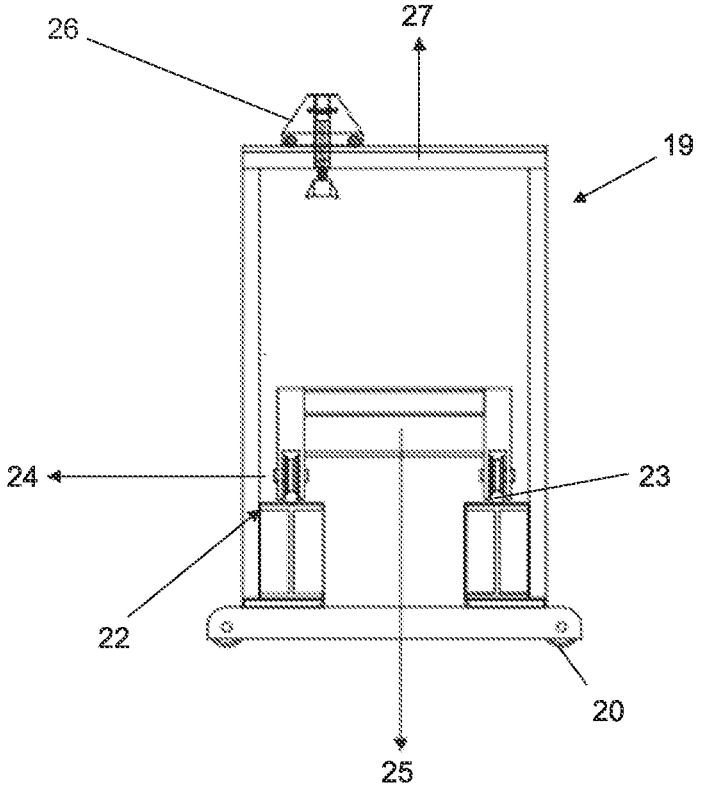
FIG. 10: Side view of the coil driver of the mobile factory of helical pipe.
Figure 11:
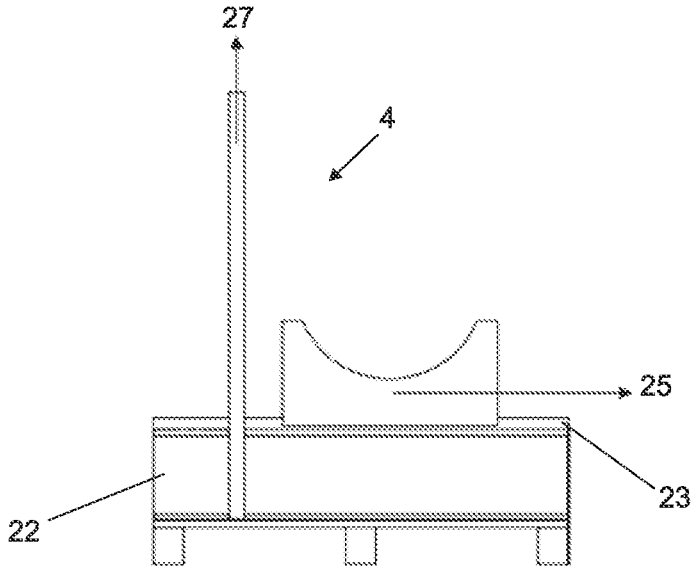
FIG. 11: Perspective view of the pipe straightener of the mobile factory of helical pipe.
Figure 12:
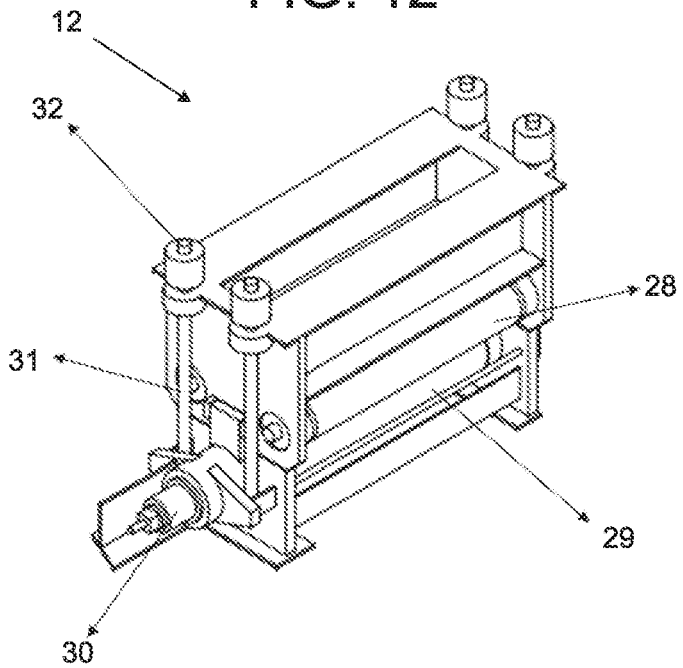
FIG. 12: Schematic side view of the mobile factory of helical pipe mounted on a raft.
Figure 13:
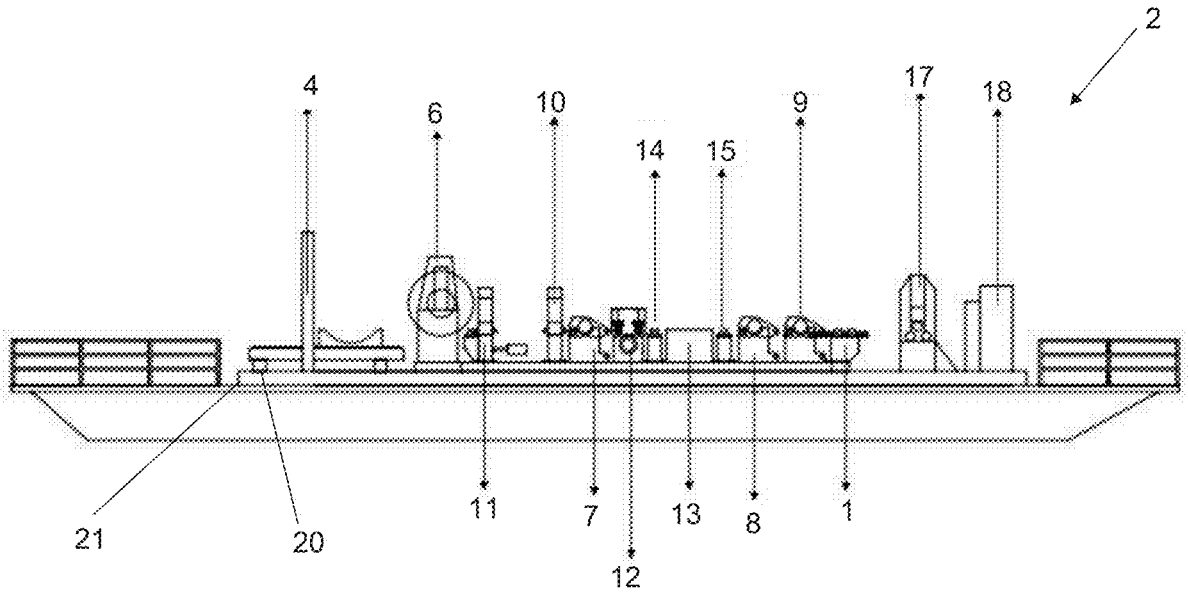
FIG. 13: Schematic top view of the mobile factory of helical pipe mounted on a raft.
Figure 14:
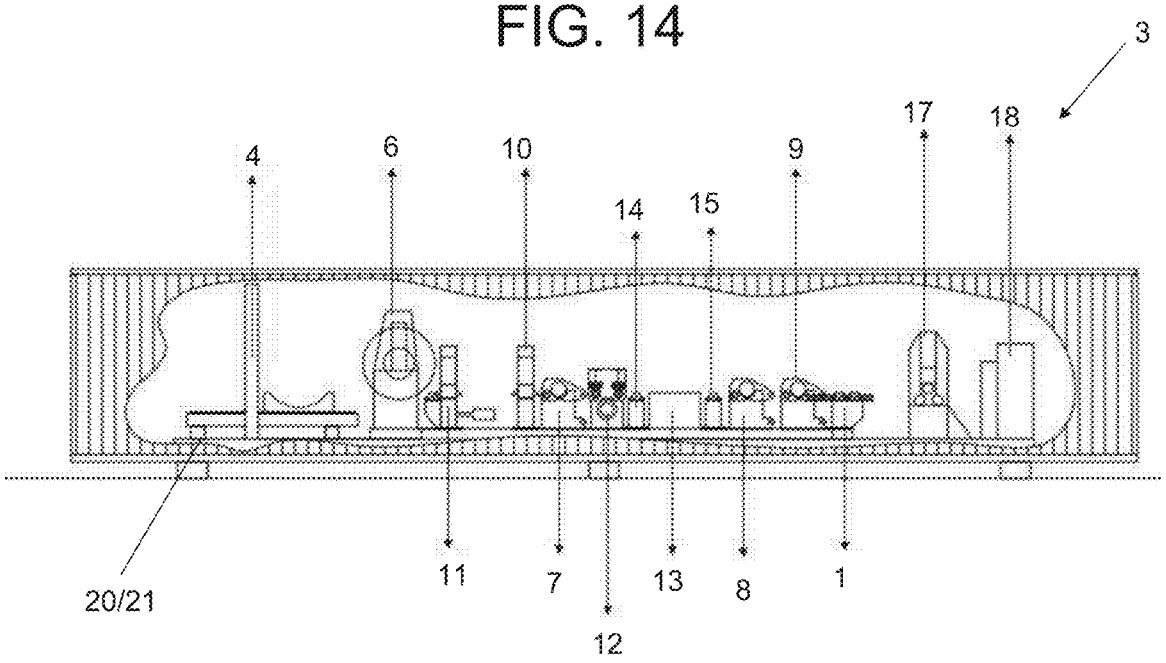
FIG. 14: Schematic side view of the mobile factory of helical pipe mounted on a container-like structure.
Figure 15:
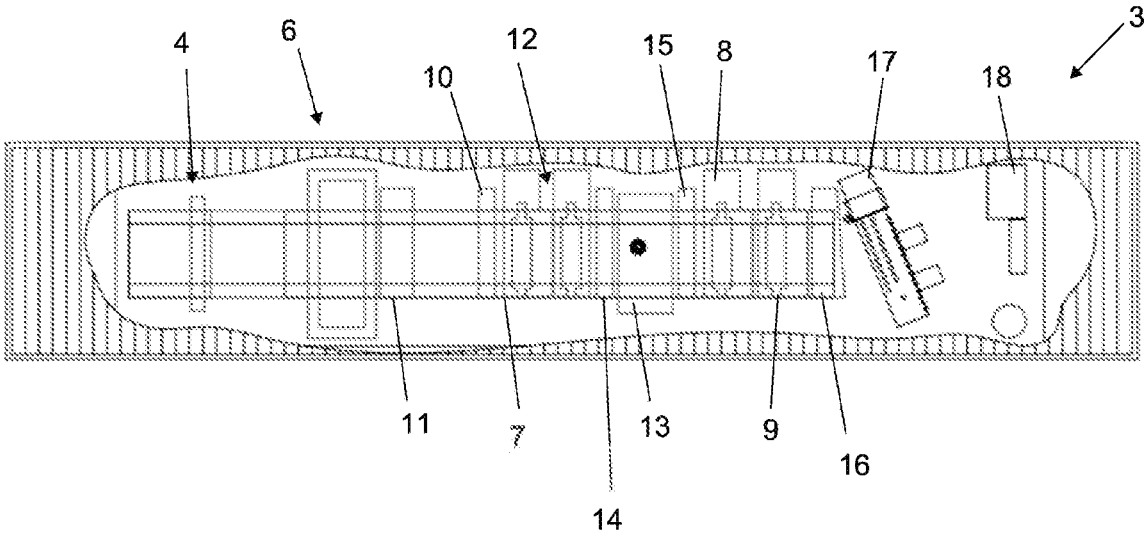
FIG. 15: Upper schematic view of the mobile factory of helical pipe mounted on a container-like structure.

MOBILE FACTORY OF STEEL SHEET COIL HELICAL PIPE, consisting of a factory for the production of helical pipes that can be mounted on trailers (1), rafts (2), container-like structures (3) which is distinguished by its high production speed and the use of steel sheet coils of up to 1" and the use of an optional coil driver (4), a beveler (13) and a wire welding system (18) that may contain two (36), three (37), four (38) or five (39) welding wires per pass (internal and external).

More specifically, the invention concerns a factory for the production of helical pipes using steel sheet coils, preferably from %" to 1" in thickness, which is mobile since it can be mounted on a low trailer (1), raft (2) or container-type structure (3), all autonomous and with sufficient electrical energy to drive the equipment necessary to transform a sheet strip into a helicoidal pipe at substantial speed, which results in a more productive factory model. The factory (1, 2, 3) for the production of helical pipes comprises an optional coil driver (4), used to speed up the changing and replacement of coils, since it enables the independent movement of the external support duly positioned in the region of the unwinder (6) where the steel sheet coil is moved by a set of at least three pullers (7, 8, 9) strategically positioned along the production line. Due to the fact that it operates with steel sheet coils of greater thicknesses and considering the need for increased production speed, it was necessary to add a press (10) to the existing press (11) and position them frontally, and to reposition the pullers (7, 8) located between the new pipe straightener (12), the bevel (13), lined by the guide tables (14, 15), this guide table (15) being followed by the optional supplementary puller (9) and another guide table (16) preceding the calander (17) and the welding machine (18). The optional coil driver (4), responsible for the swift placement of the coil in the unwinder (6), is positioned at the front of the trailer (1), raft (2) or container-type structure (3) and comprises a gantry (19) with casters (20) which, supported on rails (21) located on the factory floor (1, 2, 3), allows it to move towards the unwinder (6), where, at the base of said grantry (19) are elevated tracks (22) whose rails (23) traversed by rollers (24) allow for the sliding of the cradle (25) that receives the coil, which is moved by means of a hydraulic cart (26) located on the cross-beam (27). Positioned in the coil on the unwinder (6), the pullers (7, 8, 9) enter into action moving the steel sheet along the production line through the facing presses (10, 11) and the pipe straightener (12) where upper cylinders (28) parallel to lower cylinders (29), duly driven by electric motors (30), capable of adjustment by means of unwinders (31) with regulating locks (32), ready the steel sheet to enter the beveler (13), where the side edges are submitted to chamfers ranging between 15° and 30°, allowing for complete penetration of the weld into the joints of steel sheets with thicknesses of up to 1" and with fewer passes. The beveler (13) encompasses the two side edges of the sheet and comprises an electric motor (33) that drives the milling cutter (34) whose cutting inserts (35) are adjusted to angles of between 15° and 30°. The sheet, subjected to all the aforementioned procedural steps, maintains an alignment due to the action of the guide tables (14, 15, 16) proceeding to the calander (17) where the approximate sides take the form of a helical pipe for subsequent submission to the process of welding in the welding machine (18) where a wire welding system may contain two (36), three (37), four (38) or five (39) welding wires per pass (internal and external), either in the tandem-arc configuration (a welding source for each wire) and/or twin-arc (single welding power supply) and/or mixed (tandem-arc+twin-arc), where the choice of the system will depend on the parameters to be used.

The invention claimed is:

1. A mobile factory for production of a helical pipe from steel sheet coils using equipment mounted on an autonomous low trailer, raft, or container, the mobile factory comprising:

an unwinder configured to receive a steel sheet coil;

at least one press;

a first drive puller and a second drive puller configured to move the steel sheet along a production line;

a calander;

guide tables configured to maintain an alignment of the steel sheet in a direction of the calander;

a third drive puller positioned between the second drive puller and a guide table, of the guide tables, preceding the calander;

a welding machine comprising a wire welding system;

a pipe straightener; and a beveler configured to make chamfers ranging from 15° to 30° on side edges of the steel sheet;

wherein the pipe straightener and beveler are positioned preceding the calander and the welding machine.

2. The mobile factory according to claim 1, further comprising a second press.

3. The mobile factory according to claim 1, wherein the pipe straightener includes upper cylinders disposed parallel to lower cylinders and driven by electric motors, the upper cylinders being configured to be adjusted by spindles with regulating locks.

4. The mobile factory according to claim 1, wherein the beveler is configured to encompass two side edges of the steel sheet, the beveler further comprising an electric motor configured to drive a milling cutter having cutting inserts adjusted to angles of between 15° and 30°.

5. The mobile factory according to claim 1, further comprising a coil driver positioned before the unwinder and adapted to position the steel sheet coil on the unwinder.

6. The mobile factory according to claim 5, wherein:

the coil driver comprises a gantry with casters supported on rails located on the trailer, raft, or container, the casters being configured to enable a movement of the coil driver in a direction of the unwinder; and elevated tracks are provided at a base of the gantry, the elevated tracks having rails traversable by rollers so as to facilitate sliding of a cradle that receives the steel sheet coil, the steel sheet coil being moved by a hydraulic cart located on a cross-beam disposed above the cradle.

7. The mobile factory according to claim 1, wherein the wire welding system of the welding machine contains two, three, four, or five wires per pass.

8. A mobile factory for production of a helical pipe from steel sheet coils using equipment mounted on an autonomous low trailer, raft, or container, the mobile factory comprising:

an unwinder configured to receive a steel sheet coil;

at least one press;

a first drive puller and a second drive puller configured to move the steel sheet along a production line;

a calander;

guide tables configured to maintain an alignment of the steel sheet in a direction of the calander;

a welding machine comprising a wire welding system;

a pipe straightener; and a beveler configured to make chamfers ranging from 15° to 30° on side edges of the steel sheet;

wherein the pipe straightener and beveler are positioned preceding the calander and the welding machine; and wherein the pipe straightener includes upper cylinders disposed parallel to lower cylinders and driven by electric motors, the upper cylinders being configured to be adjusted by spindles with regulating locks.

9. A mobile factory for production of a helical pipe from steel sheet coils using equipment mounted on an autonomous low trailer, raft, or container, the mobile factory comprising:

an unwinder configured to receive a steel sheet coil;

at least one press;

a first drive puller and a second drive puller configured to move the steel sheet along a production line;

a calander;

guide tables configured to maintain an alignment of the steel sheet in a direction of the calander;

a welding machine comprising a wire welding system;

a pipe straightener; and a beveler configured to make chamfers ranging from 15° to 30° on side edges of the steel sheet;

wherein the pipe straightener and beveler are positioned preceding the calander and the welding machine; and wherein the beveler is configured to encompass two side edges of the steel sheet, the beveler further comprising an electric motor configured to drive a milling cutter having cutting inserts adjusted to angles of between 15° and 30°.

* * * * *